United States Patent [19]

Stahlecker

[11] 4,014,162

[45] Mar. 29, 1977

[54] FIBER SUPPLY DUCT FOR AN OPEN-END SPINNING UNIT

[75] Inventor: Hans Stahlecker, Sussen, Germany

[73] Assignees: Hans Stahlecker; Fritz Stahlecker, both of Germany

[22] Filed: Oct. 24, 1975

[21] Appl. No.: 625,713

[52] U.S. Cl. ..... 57/58.95

[51] Int. Cl.[2] ..... D01H 1/12

[58] Field of Search ..... 57/58.89–58.95, 57/106

[56] References Cited

UNITED STATES PATENTS

| | | | |
|---|---|---|---|
| 3,381,463 | 5/1968 | Fajt et al. | 57/58.95 |
| 3,523,300 | 8/1970 | Tabata et al. | 57/58.95 X |
| 3,688,487 | 9/1972 | Fukuta | 57/58.95 |
| 3,901,013 | 8/1975 | Sharycherkov | 57/58.95 |

*Primary Examiner*—Donald Watkins
*Attorney, Agent, or Firm*—Craig & Antonelli

[57] ABSTRACT

A fiber supply duct for an open-end spinning unit of the type having an opening device, such as an opening roller, for the opening of continuously fed fiber material. The fiber supply duct extends from the opening device and terminates in a spinning rotor with an air current effecting a conveyance of the fibers being generated in the fiber supply duct by means of a negative pressure ambient produced in the zone of the spinning rotor. The fiber supply duct is provided with a steadily widening flaring mouth section in the zone of the spinning rotor.

10 Claims, 2 Drawing Figures

FIBER SUPPLY DUCT FOR AN OPEN-END SPINNING UNIT

Figure 1:
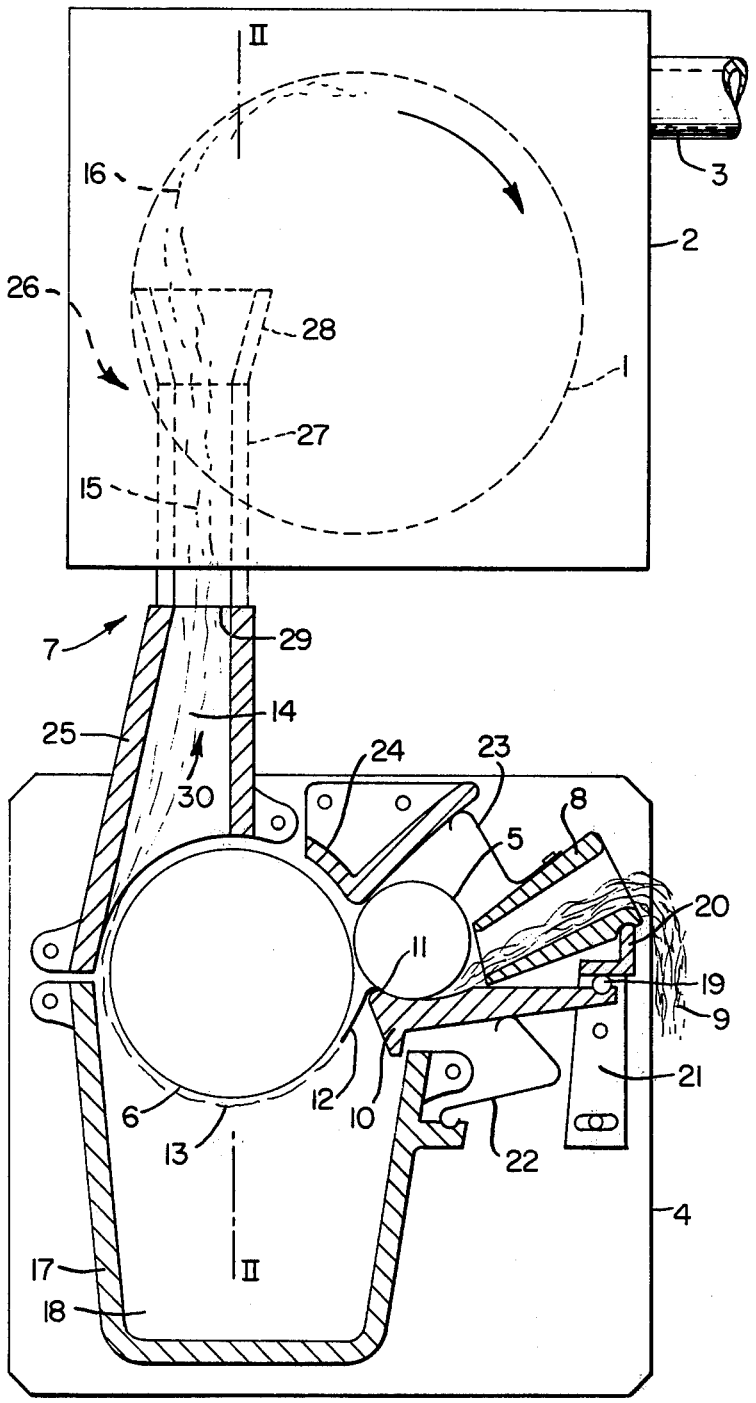

This invention relates to a fiber supply duct for an open-end spinning unit with an opening device, especially an opening roller, for the opening up of continuously fed fiber material, this opening device being followed by the fiber supply duct terminating in a spinning rotor, an air current effecting a conveyance of the fibers being generated in this fiber supply duct by means of a subatmospheric pressure ambient in the zone of the spinning rotor.

The pneumatically effected transport of the opened-up and separated fibers to the spinning rotor of an open-end spinning unit is of considerable importance for the quality of the spun thread. It is desirable, in this connection, to affect the fibers, during their transport, by the fiber supply duct and the air current so that they are deposited on the inner wall of the spinning rotor in a stretched and mutually parallel condition.

It is known (DAS [German Published Application] 1,510,741) to provide a fiber conducting tube which tapers in the conveying direction, whereby the fibers are accelerated so that they attain a speed corresponding to the velocity of the fiber-collecting groove of the spinning rotor. This may be of advantage in case of spinning rotors wherein the fiber-collecting groove is provided with needles, since otherwise there would be the danger that the needles, rotating at a substantially higher velocity, would damage the fibers. This construction has the disadvantage that considerable turbulence is produced in the air current due to the strong acceleration, leading to an entangling of the fibers due to the turbulence so that the fibers cannot be deposited in a parallel position. Under practical conditions, it has been found that such high accelerations are impracticable if turbines are employed having a smooth fiber-collecting groove, as is the case in almost all instances. It is then more advantageous to provide a marked speed difference between the arriving fibers and the rotating surface of the spinning rotor, since then the fibers can once more be stretched and optionally placed in a parallel position by the more rapidly rotating surface of the spinning rotor.

It is furthermore known (DOS [German Unexamined Laid-Open Application] 2,364,261) to provide a fiber conducting channel beginning at the opening means with a relatively strongly tapering section, followed by a cylindrical section terminating into the spinning rotor. These measures are to serve the purpose of quieting the air current in the cylindrical section so that also the fiber position is thereby stabilized.

In connection with a fiber supply duct along the above lines, it has furthermore been conventional (DOS 2,238,582) to produce the tapering section and the cylindrical section from separate individual parts, which represent a simplification in manufacture.

In all conventional types of construction, there is the disadvantage that a relatively strong turbulence occurs at the mouth of the fiber supply duct, since the latter terminates into the rotor with a relatively small cross section. Due to the abrupt transition, a point of nonuniformity is created leading to increased turbulence in this zone; such turbulence is so great under certain circumstances that the effect intended by DOS 2,364,261 is nullified.

This invention is based on the problem of providing a fiber supply duct of the type mentioned in the foregoing which makes it possible for the air current to exit from the fiber supply duct with a minimum of turbulence. The invention resides in that the fiber supply duct is equipped with a continuously widening mouth.

By the steady flaring of the mouth region, the transition of the air current when exiting therefrom into the interior of the spinning rotor is mitigated, so that also the turbulence phenomena are reduced. Besides, the objective is attained that the speed difference between the exiting fibers and the peripheral velocity of the rotor wall is somewhat increased, so that an enhanced stretching effect is achieved. When the fibers meet the rotor wall respectively with one fiber end, at first, then these ends are very greatly accelerated, and the remaining portions are pulled thereafter, whereby the desired stretching effect is produced.

Additional features and advantages of the invention can be seen from the following description of an embodiment illustrated in the drawing and from the dependent claims.

Figure 2:
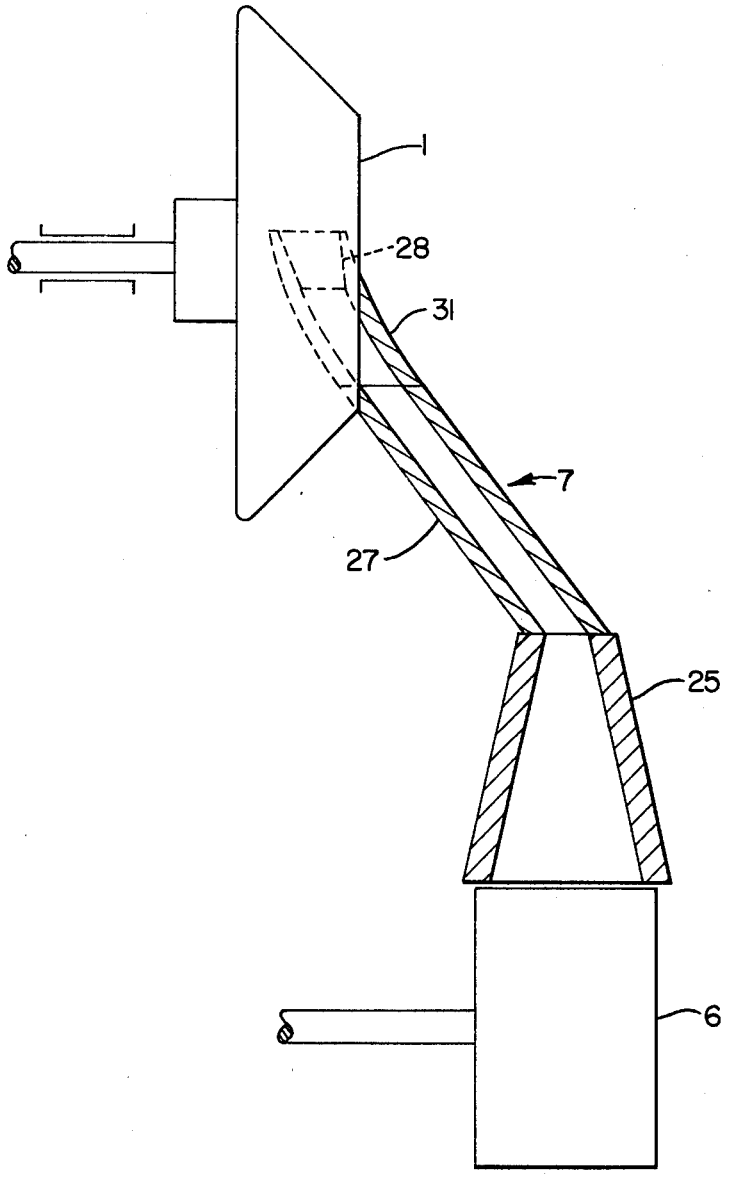

FIG. 1 shows a view, partially in section, of an open-end spinning unit with a fiber-conducting duct according to this invention; and FIG. 2 is a section along line II—II of FIG. 1.

An open-end spinning rotor 1 is arranged in a housing 2 under negative pressure, a vacuum line 3 being connected to the housing. The individual components of the associated fiber supply and opening system are mounted to a base plate 4 to be detachable and exchangeable. The supply and opening system consists essentially of a feed roll 5, an opening roller 6, as well as a fiber supply duct 7 terminating on the inside of the spinning rotor 1 rotating in the direction of the arrow, so that the fibers after meeting with the inside are drawn out further essentially in their previous conveying direction. The sliver 9 to be spun is introduced into an inlet funnel 8 and proffered by means of a feed roll 5 rotating in the clockwise direction in the form of a fiber tuft 12 to an opening roller 6 rotating in the same sense, but at a higher speed. The fiber tuft 12 is clamped between the feed roll 5 and a feed table 10 under the pressure of a spring 22 along a clamping line 11. By means of the opening roller 6, individual fibers 13 are combed out of the fiber tuft 12 and fed in the fiber supply duct 7 as separate fibers 14 to the spinning rotor 1 in the conveying direction 30. The fibers are thus deposited on the inner wall of the spinning rotor. The plate 4 furthermore carries, mounted thereto, a housing 17 defining a dirt collecting chamber 18 for yarn impurities, a holder 21 for supporting the feed table 10 by means of a ball bearing 19, a holding plate 20 for supporting the inlet funnel 8, as well as a guide element 24 against which rests a supporting spring 23 for the inlet funnel 8.

The fiber supply duct 7 contains a first section 25 tapering in the conveying direction 30 of the fibers 14 and attached to the base plate 4. A second section 26 follows, forming a preferably cylindrical portion 27 with a uniform cross section. A section 28, flaring in the manner of a funnel, follows portion 27. The section 26 of the supply duct 7 can be arranged on a component, not shown, which extends into the spinning rotor 1. The parting line 29 of the sections 25 and 26 is provided at the transition between the first tapering section and the subsequent cylindrical section, whereby considerable simplifications are attained in the manufacture. The cylindrical section 27 and the conically tapering section 25 of the fiber supply duct have, at least in the order of magnitude, the same length, whereas the length of the funnel-shaped section 28 amounts to no more than half the length of the section 25 and preferably about one-fifth of the total length of the fiber supply duct 7. This configuration has the result that the fibers 14 detached from the opening roller 6 and conveyed in the transport direction 30 are initially accelerated, then stabilized in the cylindrical section 27 (fibers 15), and thereafter are somewhat slowed down in the funnel-shaped section 28, thereby obtaining simultaneously an extensively harmonic transition of the exiting fibers 16 to the inner wall of the spinning rotor 1. An intentional, larger difference exists between the velocity of the fibers exiting from the funnel 28 and the peripheral speed of the inner wall of the spinning rotor 1.

As can be seen from FIG. 2, the opening roller 6 and the spinning rotor 1 are arranged somewhat offset with respect to each other, even if their axes extend mutually in parallel. This offset arrangement must then be bridged by the fiber supply duct 7. In the illustrated embodiment, this is accomplished by the central section 27 adjoining the section 25 at an angle, the section 25 being arranged symmetrically to the center of the opening roller 6. The section 27 then passes over, with an angled part 31, into the flaring section 28 constituting the mouth. Optionally, the sections 27 and 31 can be made from mutually independent portions. In certain cases, it is possible to fashion the section 31 to be integral with the section 28.

The component forming the section 27 need not have a cylindrical cross section. It is also advantageous in some cases to select a different cross-sectional configuration, in particular an oval cross-sectional shape which then passes over into a section 28 beveled approximately in parallel with the bottom of the spinning rotor and forming the flaring mouth. This section can then likewise be beveled.

What is claimed is:

1. Fiber supply duct for an open-end spinning unit with an opening device, especially an opening roller, for the opening up of continuously fed fiber material, this opening device being followed by the fiber supply duct terminating in a spinning rotor, an air current effecting a conveyance of the fibers being generated in this fiber supply duct by means of a negative pressure ambient in the zone of the spinning rotor, characterized in that the fiber supply duct is provided with a steadily widening flaring mouth, and characterized in that the supply duct comprises a tapering section beginning at the opening means and tapering in the conveying direction of the fibers, and a flaring section constituting the flaring mouth.

2. Fiber supply duct according to claim 1, characterized in that a section with a uniform cross section is provided between the tapering section and the flaring section of the fiber supply duct.

3. Fiber supply duct according to claim 2, characterized in that the section of the supply duct adjoining the opening means, especially the opening roller, extends symmetrically to the center of the opening means; and that a middle section of a uniform cross section executes a change in direction between the two outer sections.

4. Fiber supply duct according to claim 2, characterized in that the length of the flaring section constituting the mouth amounts to about one-fifth to one-fourth of the length of the entire fiber supply duct.

5. Fiber supply duct according to claim 1, characterized in that the supply duct is composed of pieces corresponding to the lengths of the different sections thereof.

6. Fiber supply duct according to claim 4, characterized in that the supply duct is composed of pieces corresponding to the lengths of the different sections thereof.

7. Fiber supply duct according to claim 2, characterized in that the section of the supply duct adjoining the opening means, especially the opening roller, extends symmetrically to the center of the opening means; and that the middle section of a uniform cross section executes a change in direction between the two outer sections.

8. Fiber supply duct for an open-end spinning unit with an opening device, especially an opening roller, for the opening up of continuously fed fiber material, this opening device being followed by the fiber supply duct terminating in a spinning rotor, an air current effecting a conveyance of the fibers being generated in this fiber supply duct by means of a negative pressure ambient in the zone of the spinning rotor, characterized in that the fiber supply duct is provided with a steadily widening flaring mouth, and characterized in that the length of the flaring section constituting the mouth amounts to about one-fifth to one-fourth of the length of the entire fiber supply duct.

9. Fiber supply duct according to claim 8, characterized in that lengths of the tapering section and the section having a uniform cross section approximately correspond to each other.

10. Fiber supply duct for an open-end spinning unit with an opening device, especially an opening roller, for the opening up of continuously fed fiber material, this opening device being followed by the fiber supply duct terminating in a spinning rotor, an air current effecting a conveyance of the fibers being generated in this fiber supply duct by means of a negative pressure ambient in the zone of the spinning rotor, characterized in that the fiber supply duct is provided with a steadily widening flaring mouth, and characterized in that the supply duct is composed of pieces corresponding to the lengths of the different sections thereof.

* * * * *